US005839246A

United States Patent [19]

Ziegler et al.

[11] Patent Number: 5,839,246

[45] Date of Patent: Nov. 24, 1998

[54] GRID FRAMEWORK FOR SUSPENDED CEILING

[75] Inventors: Daniel C. Ziegler, Millersville; William J. Platt, Aston, both of Pa.

[73] Assignee: Worthington Armstrong Venture, Malvern, Pa.

[21] Appl. No.: 712,764

[22] Filed: Sep. 12, 1996

[51] Int. Cl.[6] ..... F04C 2/42

[52] U.S. Cl. ..... 52/506.07; 52/667; 403/347

[58] Field of Search ..... 52/506.06, 506.07, 52/665, 667, 668; 403/347

[56] References Cited

U.S. PATENT DOCUMENTS

| | | | |
|---|---|---|---|
| 3,501,185 | 3/1970 | Brown et al. . | |
| 4,106,878 | 8/1978 | Jones . | |
| 4,108,563 | 8/1978 | Brown et al. | 52/667 X |
| 4,535,580 | 8/1985 | Shirey | 52/665 X |
| 4,601,153 | 7/1986 | Dunn et al. . | |
| 4,785,603 | 11/1988 | Platt . | |
| 4,827,681 | 5/1989 | Platt . | |
| 4,912,894 | 4/1990 | Platt . | |
| 5,044,138 | 9/1991 | Zaccardelli et al. | 52/506.07 X |
| 5,216,865 | 6/1993 | Lalonde et al. | 52/667 |
| 5,271,202 | 12/1993 | Vukmanic et al. | 52/506.07 X |
| 5,517,796 | 5/1996 | Koski et al. | 52/506.07 |

*Primary Examiner*—Carl D. Friedman
*Assistant Examiner*—Winnie S. Yip
*Attorney, Agent, or Firm*—Eugene Chovanes

[57] ABSTRACT

A grid framework for a suspended ceiling wherein reinforced cross members are allowed to expand; without collapsing or buckling, during a fire. Clips at the end of the members create barriers that are successfully overcome, in stages, to relieve any excess longitudinal compressive forces capable of being built up by the reinforced members.

11 Claims, 10 Drawing Sheets

GRID FRAMEWORK FOR SUSPENDED CEILING

BACKGROUND OF THE INVENTION

1. Field of the Invention

Suspended ceilings having a metal grid framework which supports panels of acoustical tile within rectangular enclosures formed by the framework are used extensively in commercial and industrial buildings. This invention deals with the problem of keeping such a ceiling intact during a fire, so that the ceiling can act as a fire barrier to the supporting structure above the ceiling.

More specifically, the invention relates to a grid framework that keeps the rectangular framework enclosures relatively intact during a fire, so that the framework continues to support and enclose the rectangular heat resistant panels during such fire.

The invention deals with the well-known problem of the metal framework members distorting during a fire by expanding, buckling, and twisting, whereby the supported ceiling panels are displaced and dropped through the openings formed by the buckled rib members; thus destroying the effectiveness of the suspended ceiling as a fire barrier, and permitting the fire to attack the building support structure.

2. Prior Art

Attempts have been made to solve the problem of expansion of the grid members by forming cut-outs, or "weak points" along the runners. The runners collapse longitudinally, in compression, to compensate for the expansion during a rise in temperature due to a fire in an effort to keep such runners oriented longitudinally in an effective rectangular grid arrangement. This approach has been mostly confined to the main runners. A major problem with this approach is that the grids are weakened by such cut-outs and there is a substantial waste of grid strength and material in the portions of the grid which are not cut-out. As with a chain which is only as strong as its weakest link, the main runner, which is of T-cross section, is only as strong as the strength at the cut-out. The weakened portion of the grid in effect creates the grid strength threshold under normal operating conditions, and the unweakened portions of the grid are compromised in terms of such grid strength threshold.

In another approach to this problem, the cross runners have not been weakened by a cut-out, but attempts have been made to have clips at the ends of the runners bend so that expansion of the runner is handled by permitting the cross runner to either move diagonal in the grid path, or move sideways at the ends. The problem with this approach is that gaps in the ceiling are created, reducing the effectiveness of the ceiling as a fire barrier.

In still another approach, again the cross runner is not weakened, with the end clip on the runner shearing through the main runner web at its slot to provide the necessary cross runner expansion to avoid buckling. Such an approach can not utilize the well known prior art concept of an internal clip to clip connection in both directions, and specifically not in the forward direction where the clip is being forced toward the main runner. Such approach sacrifices the all important feature of having an end abutment in the form of a backstop between the opposing clips which is important in the control of module size and tolerance. This approach sacrifices the precise fit between the clips in the connection, resulting in a relative loose joint.

SUMMARY OF THE PRESENT INVENTION

The present invention, rather than weakening the grid members to provide for a controlled collapse longitudinally of the runner to compensate for longitudinal expansion during a fire, leads entirely in the opposite direction. The invention uses cross runners that are not intended to collapse in expansion, but are reinforced against such collapse by longitudinal compression as by web stitching. The members do not collapse during a fire, but are permitted to expand in a controlled manner to maintain the original rectangular layout of the ceiling.

End clips are used on the cross runners, in combination with a defined slot in the main runner, which provides a series of barriers, or resistances to the continued expansion of the cross runner at stages during such expansion. The resistances create, in successive stages, forces which rise and fall, whereby the cross runners continue to be firmly joined to the main runner tee at all stages of the cross runner expansion without creating an unyielding barrier to such expansion, which would cause the cross runner to buckle, and open up the ceiling.

The invention continues to use the prior art concept of a backstop. This is important, in that it provides a firm and relatively unyielding barrier, in normal non-fire conditions, between opposing interlocking clips. However, by virtue of particularly the reinforcements to the cross runner web, the cross runner during expansion from a fire is utilized, along with a cam action, to disengage the backstop in one of the relieving stages in the operation of the invention.

The invention thus utilizes the maximum strength of the grid framework in its normal non-fire condition. This permits a thinner gauge metal to be used in forming the T-cross section runner when such thinner gauge metal is reinforced at the web by for instance cross stitching, or welding. The reinforced grid can exert the necessary force in the expansion, without buckling to overcome the series of resistances created by the interconnection of the cross runner clips, and the main runner slot, and particularly, through such action, disengage the backstop, which can require a force of 100 pounds or more.

The invention permits, at periodic intervals or stages, in the grid expansion, the resistance to diminish or to completely disappear, and then to again grow.

Thus, in stages during the grid expansion, the resistance begins developing until there is the build-up to the point wherein if the resistance were not diminished or eliminated, the clip would bend laterally causing disorientation of the grid out of the rectangular configuration in which it lies. Again, the resistance exerted by the clip is diminished or eliminated so that continued expansion of the rigid grid in its line of orientation in the rectangular configuration continues.

During a fire, a general expansion of about 0.1 of an inch per foot occurs so that in a generally 4 foot length cross runner, the total expansion is about 0.4 inches. In the present invention a controlled resistance and release is effected until full expansion under extreme fire conditions occurs at which point the clip is in a final posture at the end of the cross runner expansion.

In summary, the present invention utilizes a member intended to maintain its integrity under expansion which creates longitudinal extending compressive forces on the grid member. Since a relatively high force is needed to overcome particularly the backstop barrier between the clips in an expansion, the cross member and clips are reinforced to necessarily contribute to the strength of the cross runner in overcoming the backstop barrier particularly. Staged resistance to and release from these compressive forces are provided during the grid expansion by means of the clips and slot of the invention. This permits the cross runners and main runners, to continue to provide a supporting framework around the perimeter of each rectangular panel so that the panel stays in place.

BRIEF DESCRIPTION OF THE DRAWINGS

FIG. 1 is a fragmentary exploded isometric view showing a portion of a main fire rated runner whose vertical web includes a slotted opening through which the clipped ends of fire rated and staked cross runners are to be inserted.

FIG. 2 is an enlarged side elevational view of the clip of the invention.

FIG. 3 is a plan view of FIG. 2.

FIG. 4 is a left hand end elevational view of FIG. 2 taken on the line 4,4 of FIG. 2.

FIG. 5 is a sectional elevational view taken on the line 5,5 of FIG. 2.

FIG. 6 is a side elevational view of the clip showing the reverse side of FIG. 2.

FIG. 7 is an enlarged fragmentary sectional elevational view showing the elements of FIG. 1 assembled in a first and normal use interlocking mode.

FIG. 8 is an enlarged fragmentary sectional plan view taken on the line 8,8 of FIG. 7 showing the interlocking arrangement of the fire rated main runner, cross runners and end clips.

FIG. 9 is an enlarged fragmentary sectional elevational view taken on the line 9,9 of FIG. 7 showing the side by side relationship of the two interlocked clips in the normal interlocked mode shown in FIGS. 7 and 8.

FIGS. 20A & B are fragmentary-schematic plan views illustrating how the cross runners enlongate in a straight axial direction, normal to the plane of the axis of the main runner.

FIGS. 21A and B are fragmentary schematic plan views of typical prior art cross runner assemblies having typical interconnecting clips. Illustrating the massive arcuate displacement of the cross runners with respect to the center line of the slot in the main runner due to the present design of the cross runner clips, which do not pass through the slot in the main runner during elongation but bend.

DESCRIPTION OF THE PREFERRED EMBODIMENT

1. The construction

Figure 1:
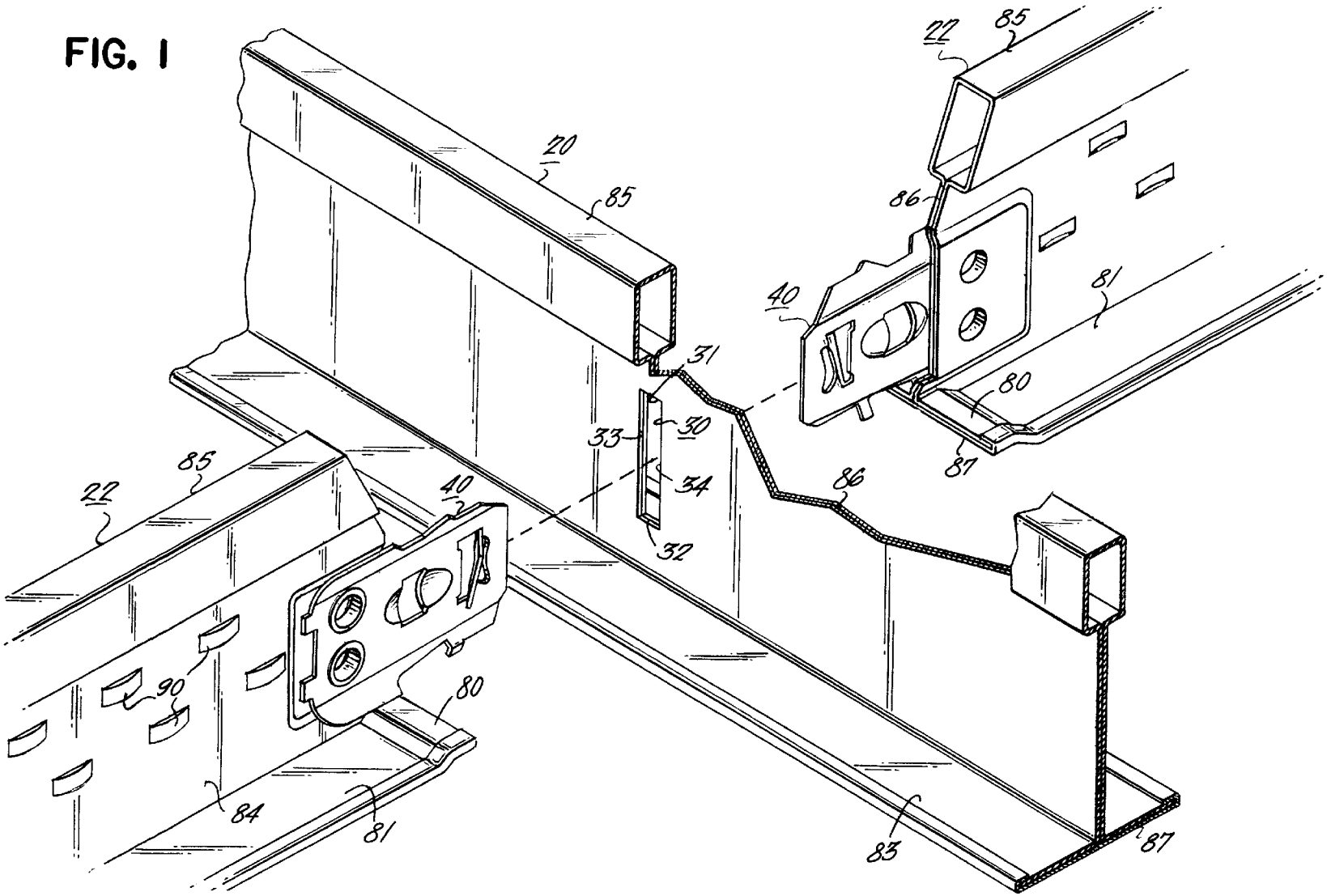
FIGS. 1 through 6 shows elements of the grid framework including the main runner, cross runner, and clips.

There is shown in FIGS. 1 through 6 the main runner 20 with a slot 30 and the cross runners 22, along with the clips 40 at the end of the cross runners 22. The fixed dimensions of the vertically extending rectangular slot 30 are used to control movements of the clips 40 relative to one another and of the clips toward one another in terms of the longitudinal advance of the clip into the slot. It is this advance of the clips 40 into the slot that permits the controlled expansion of the cross runners 22, so that the rectangular pattern of the grid is maintained during a fire. Definitions in reference to the slot 30 fixed shape are:

vertical—as seen in FIG. 1, the direction between the top 31 of the slot 30 and the bottom 32 of the slot.

outward—toward side 33 from within the slot 30 or toward side 34 from within the slot 30.

inward—from side 33 toward the interior of the slot 30 or from side 34 toward the interior of the slot 30. The inward sides of interlocking clips 40 will lie next to one another as the hands in a human handshake.

upward—in a direction from within the interior of the slot 30 toward the top 31.

downward—in a direction from the interior of the slot 30 toward bottom 32.

leading—in a direction from outside the slot 30 towards or through the slot 30.

trailing—behind leading

Clip 40 has a web 41 having therein two rivet holes 42. Clip 40 has a top 43, a bottom 44, a leading edge 45 and a trailing edge 46.

Figure 3:
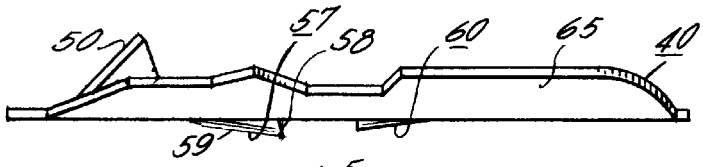
Figure 4:
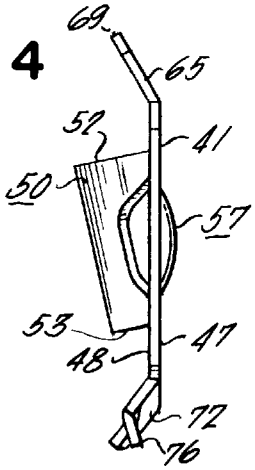
Figure 5:
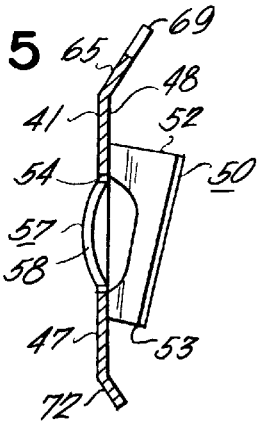

As seen in FIGS. 4 and 5, the web 41 of clip 40 has an inward side 47 and an outward side 48. A spring retaining ear 50 extends at an angle to the web 41 on the outward side 48 of the clip. Ear 50 has at its base cut-out 51. Cut-out 51 permits ear 50 to be bent at a suitable angle, for instance a compound angle which approximates 45 degrees to the web. As noted in FIGS. 3 through 6, the ear 50 extends in a slightly oblique fashion wherein the top of the ear at 52 has a longer edge than the bottom of the ear at 53.

The function of the ear 50 is to initially hold a clip 40 locked into the slot 30. The clip 40 is pushed through the slot 30 causing the ear 50 to momentarily flex to permit movement through the slot 30 after which the ear 50 returns to its original position and prevents withdrawal. This initial holding is of a temporary nature and does not enter to any substantial extent in the subsequent locking arrangement as will be described. The design and function of such an ear 50 is well known in the prior art.

Rearwardly, of the leading edge 45 and of ear 50, in the web 41, is a void or cut-out 54. The void 54 has at its leading edge an arcuate edge 55 and at the trailing portion of cut-out 54 there extends a straight edge 56.

In front of both the leading edge 55 and the trailing edge 56 of cut-out 54 there are protrusions on the inward side 47 of web 41. A first protrusion which forms a cam 57, somewhat parabolic in profile, is pressed or stamped inwardly as seen for instance in FIGS. 3, 4, and 5.

Figure 2:
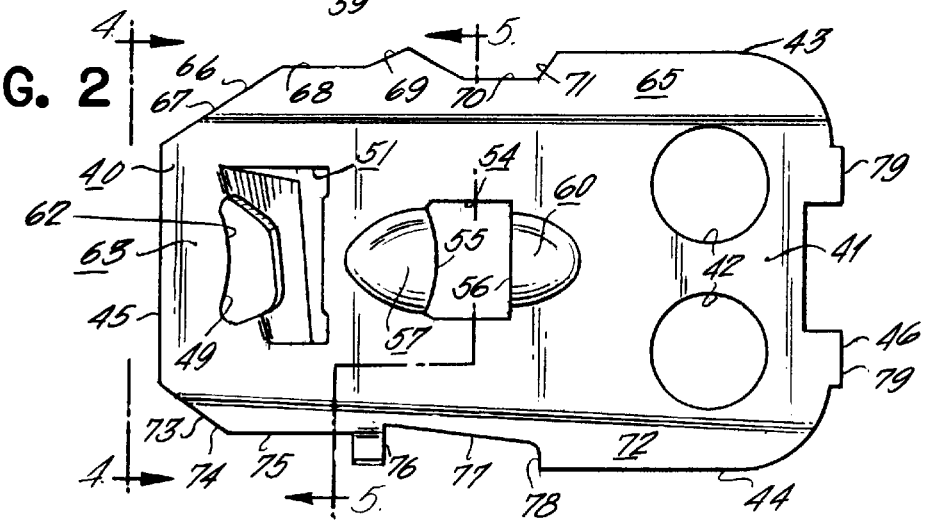

The cam 57 has an edge 55 which is not only arcuate as seen in for instance FIG. 2 but also has an inclined edge which forms as seen in FIG. 3 a barb effect 58.

The surface of cam 57 forms an inclined surface 59 from the web 41.

The terms such as inward and outward refer to the position of the clip 40 when set within the slot 30 as set forth in the definitions.

To the rearward of inwardly projecting cam 57 is a protrusion or backstop 60 that also projects inward. As seen in particularly FIG. 3, backstop 60 extends inwardly from the web 41 to a lesser distance than does projecting cam 57. Backstop 60 is stamped from the web 41. Backstop 60 has a straight edge 56, formed as described above which acts as a stop.

Figure 6:
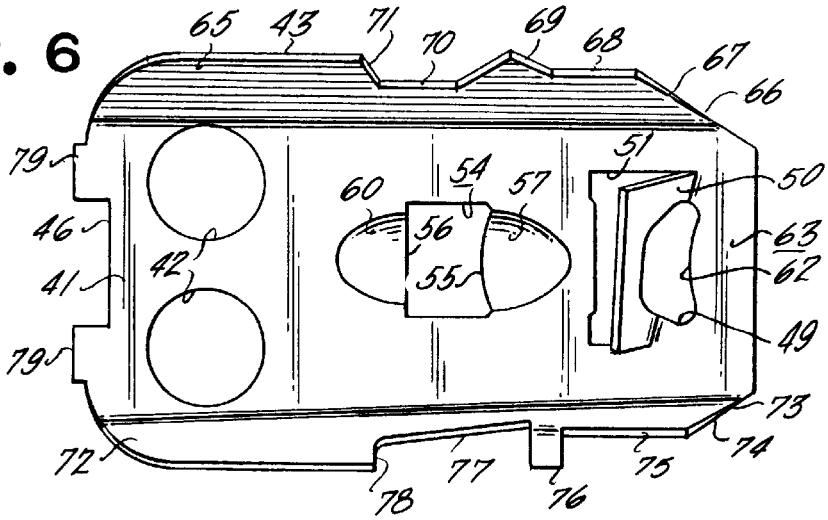

As seen particularly in FIGS. 2 and 6, a vertical strip 63 is formed at the leading end of the clip 40 and is defined by edge 45, arcuate edge 62, and the upper and lower portions of the web 41 at that location created by cut-out 49. This forms a leading vertical locking portion or strip 63.

At the top 43 of the clip 40 there extends an outwardly disposed flange 65 approximately 30 degrees to the plane of the web 41 of the clip 40. This angled flange 65 has a contoured edge 66 which includes a angled portion 67, a straight portion 68, a triangular portion 69, a depressed portion 70 and a riser 71 which forms a limit edge.

At the bottom of the clip 40 there extends an angled bottom flange 72 having a contoured portion 73 which includes a bevel 74, a flat 75, a stop 76, a lower incline 77 and a riser portion 78 which also forms a stop. At the trailing edge of the clip 40 a contoured portion simply permits the clips to be made in pairs with the trailing edge in common for each pair of clips, after which the clips, are severed from one another at portions 79.

The cross runners 22 are reinforced at their webs 84 by cross stitching 90. The stitches are imparted to the webs by for instance rolls cooperating to form the stitching as the members are formed from a single flat strip. Such formation of a T-cross beam is well known, wherein the strip is progressively bent by rolls into, in cross section, a hollow bulb, a double layered web, and outwardly extending flanges. The cross stitching, which in effect is a piercing and bending of portion of the metal, holds the layers of the web from shifting with respect to one another under compressive forces, thus preventing buckling. The flanges are suitably capped by a separate strip. The cross stitching and forming of the cross member into T-cross section from a flat strip is shown in U.S. patent application Ser. No. 08/375,261, filed Jan. 19, 1995 titled Rollformed Sections and Process for Producing Same; and in UK Patent GB 2274080 B for Ceiling Runners and Process for Producing Same published Jun. 9, 1995, both of which are incorporated herein by reference. The flanges are suitably capped by a separate strip.

As seen in FIG. 1, cross runner 22 has a bulb 85, a layered web 84, a flange 81 and a cap 87. The main runner 20, has the same cross sectional T shape. As the cross runner 22, and main runner 20 are the same in cross section, they have the same referring numbers per the corresponding parts.

It should be understood that the clips 40 are all alike and when engaged as will be described, form a complimentary relationship much as in a human handshake between two individuals.

The Operation

In operation, as the temperature of the grid framework rises from a fire, cross runner 22 expands from its cool state to its fully expanded state. This expansion is illustrated, for the standard 4 foot length cross runner, on the horizontal axis of the chart in FIG. 19. Since the expansion is accommodated at both ends of the cross runner 22, it should be understood that the clip 40 advances through the slot 30 in the main runner 20 at each end of the cross runner 22 one-half the distance indicated in FIG. 19

Figure 8:
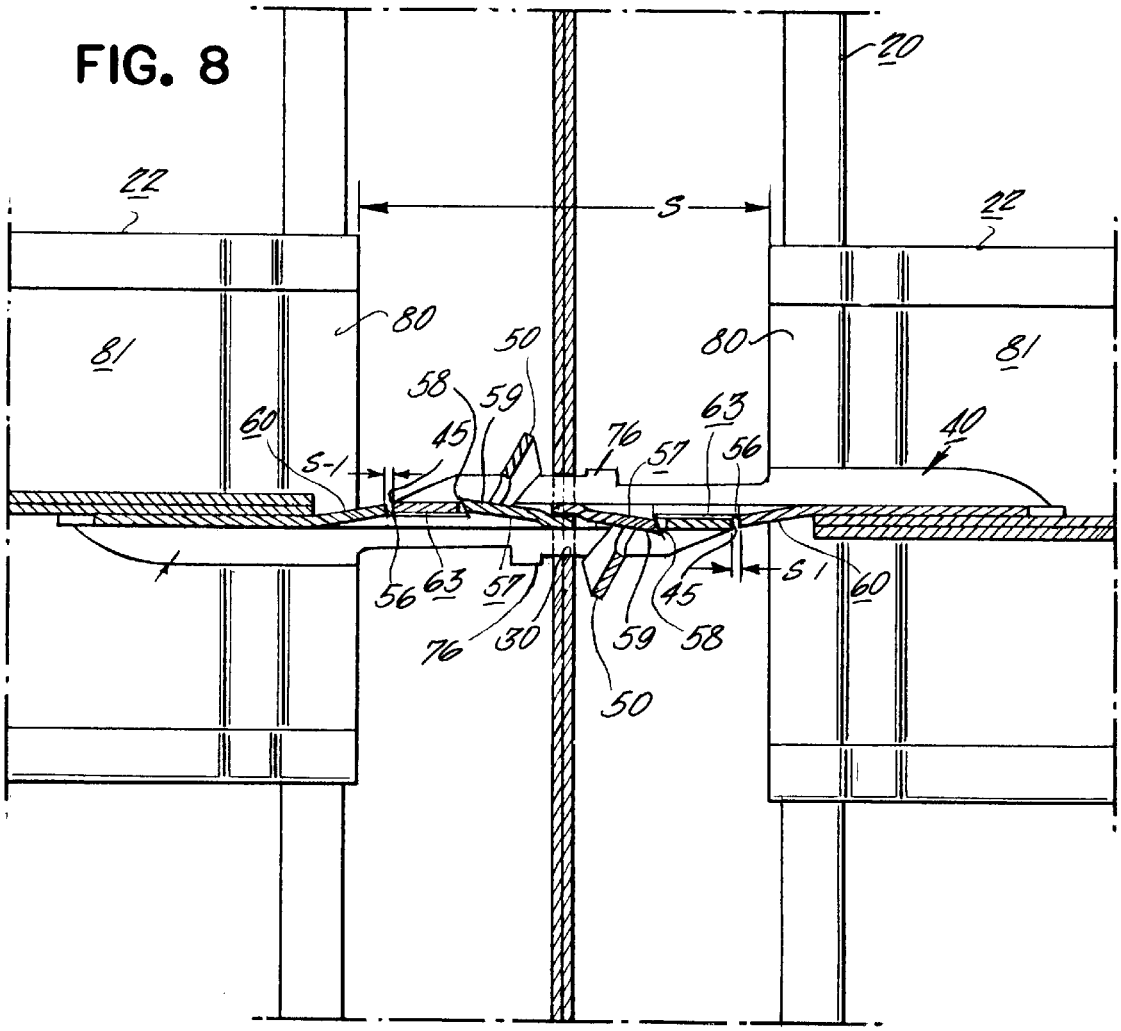

The connection at rest when there is no fire and no expansion is shown particularly in FIG. 8. This corresponds to 0 advance in the graph of FIG. 19.

To create such a connection, the grid framework is assembled by first suspending from a support structure main runners 20 in the well known prior art manner, as by wires. The runners 20 with slots 30 punched therein at periodic intervals such as two or four feet along the runner, are spaced across the ceiling in parallel relationship, four feet apart. Cross runners 22, with staked-on clips 40 at each end, are individually connected to main runners 20 by inserting a clip 40, at the end of cross runner 22 into slot 30 of main beam 20 from opposing sides of the slot, in the well known prior art manner.

Figure 7:
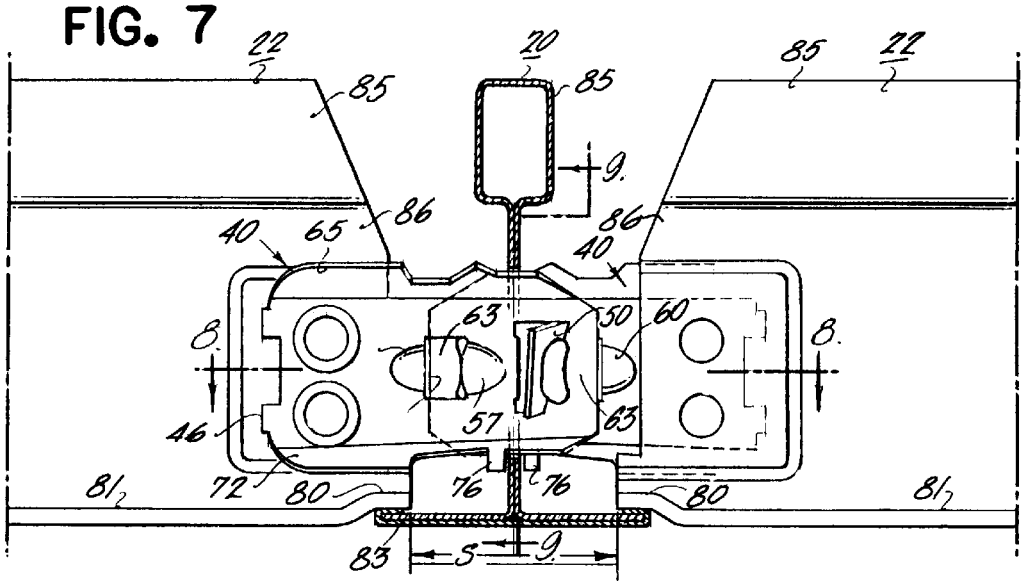
FIGS. 7 through 9 show the connection where there is zero expansion of the cross runner, before a fire starts.
Figure 9:
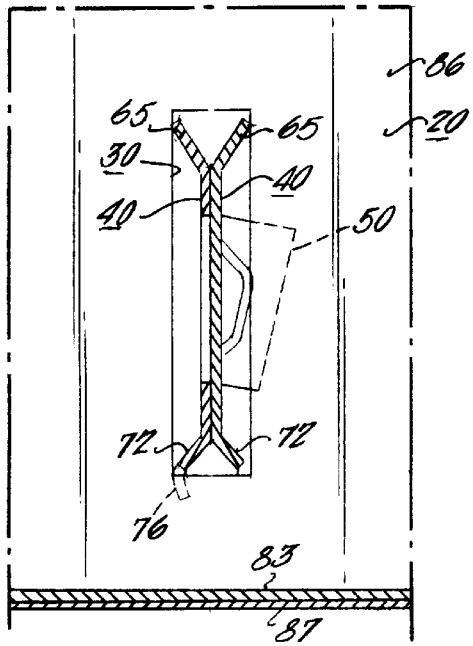
Figure 12:
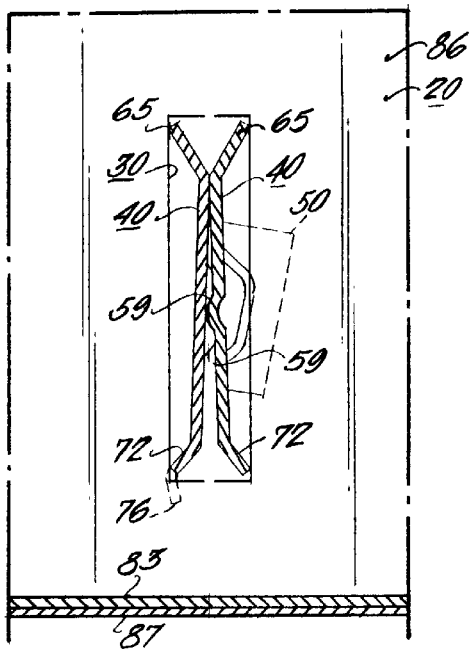
FIG. 12 is a fragmentary sectional elevational view taken on the line 12,12 of FIG. 10 similar to FIG. 9 but showing the adjusted orientation of the clips within the slotted opening in the main runner as the ends of the cross runners and associated clips expand from a zero interlocked rest position through an unlatched distance S-2.
Figure 10:
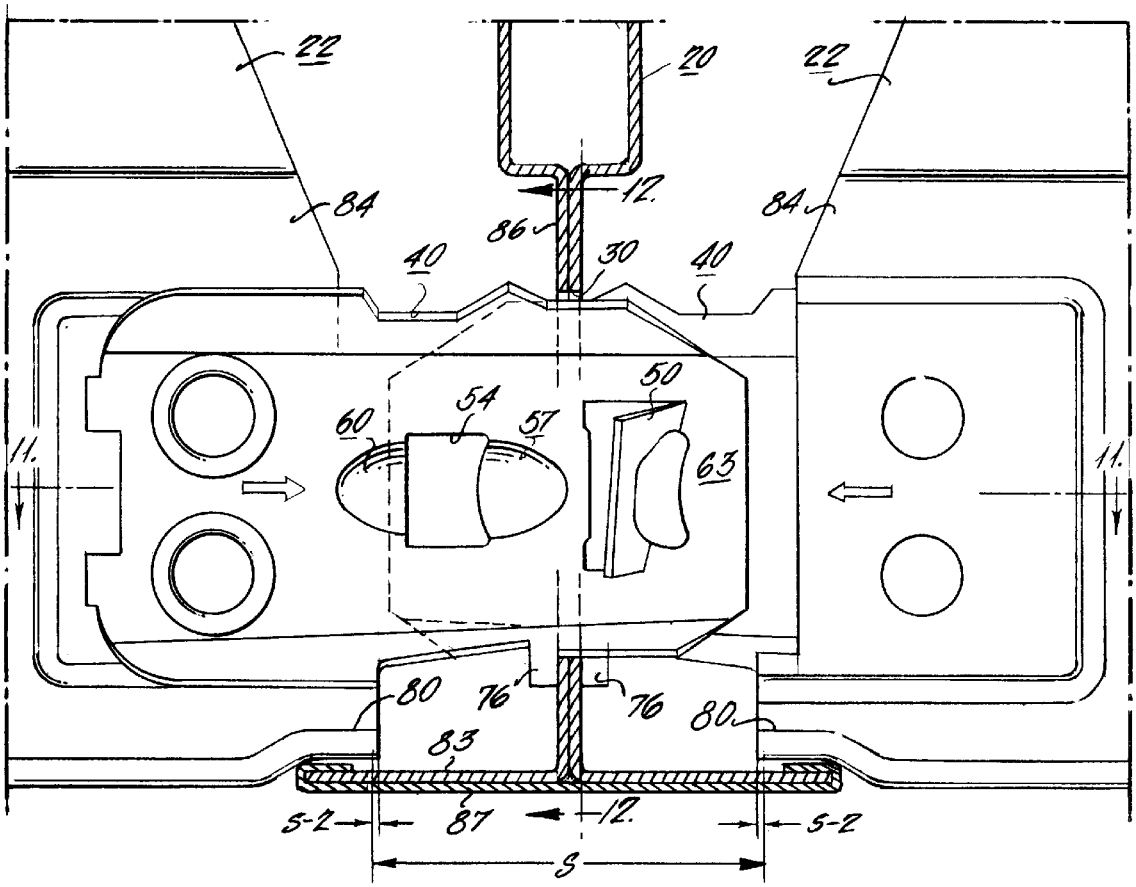
FIG. 10 is an enlarged fragmentary sectional elevational view similar to FIG. 7 but showing the two opposed cross runner ends and associated clips having expanded toward each other, due to the heat from a fire, each cross runner end and associated clip having expanded a distance S-2 or 0.01 inches from zero expansion bringing the lower stop tabs of both clips into pressured contact with the vertical web of the main runner on either side of the main runners slotted opening.
Figure 11:
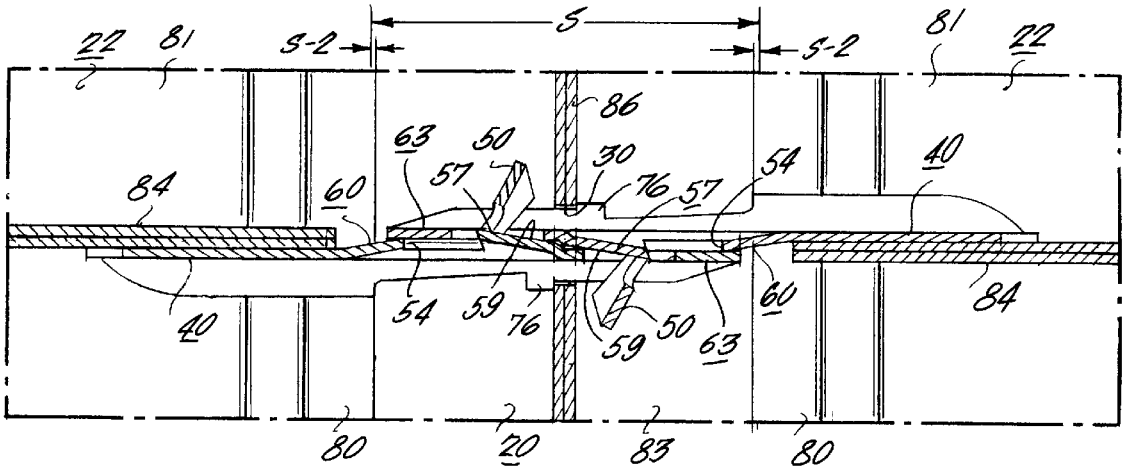
FIG. 11 is a sectional plan view taken on the line 11,11 of FIG. 10 showing the unlatched interengaging relationship of the two opposed clips with respect to the slotted opening in the main runner.

In the position shown in FIGS. 7 through 9, slot 30 keeps the opposing clips 40 abutting one another on their inward sides by virtue of the contact of the outwardly disposed flange 65 of the clips 40 against the sides of slot 30. A raised lip 80 on the flange 81 of cross runner 22 in the form of an offset is in contact with and overlays flange 83 of the main runner 20. The vertical strip 63 lies within cut-out 54 with the leading edge 45 abutting against straight edge 56 of backstop 60. This abutment provides a barrier against further movement of the clip into the slot 30. Strip 63 is also prevented from being withdrawn from the slot 30 by the action of barb 58 and arcuate edge 62 of the portion 63. Strip 63 is kept in cut-out 54 in the position shown by the flanges 65 within the confines of slot 30. This conforms to the position along the horizontal axis in graph shown in FIG. 19 at clip advance position 0. Barbs 58 serve to prevent withdrawal of the clip when the cross runner is subjected to tension, and can withstand substantial tension forces approaching 350 pounds and beyond.

The distance S shown in FIG. 8 of the drawings shows the initial distance separating the terminal ends of the two opposed cross runners 22 when their associated clips 40 are interlocked within the confines of the slotted opening 30 in the vertical web 86 of the main runner 20 and there is no fire.

Figure 13:
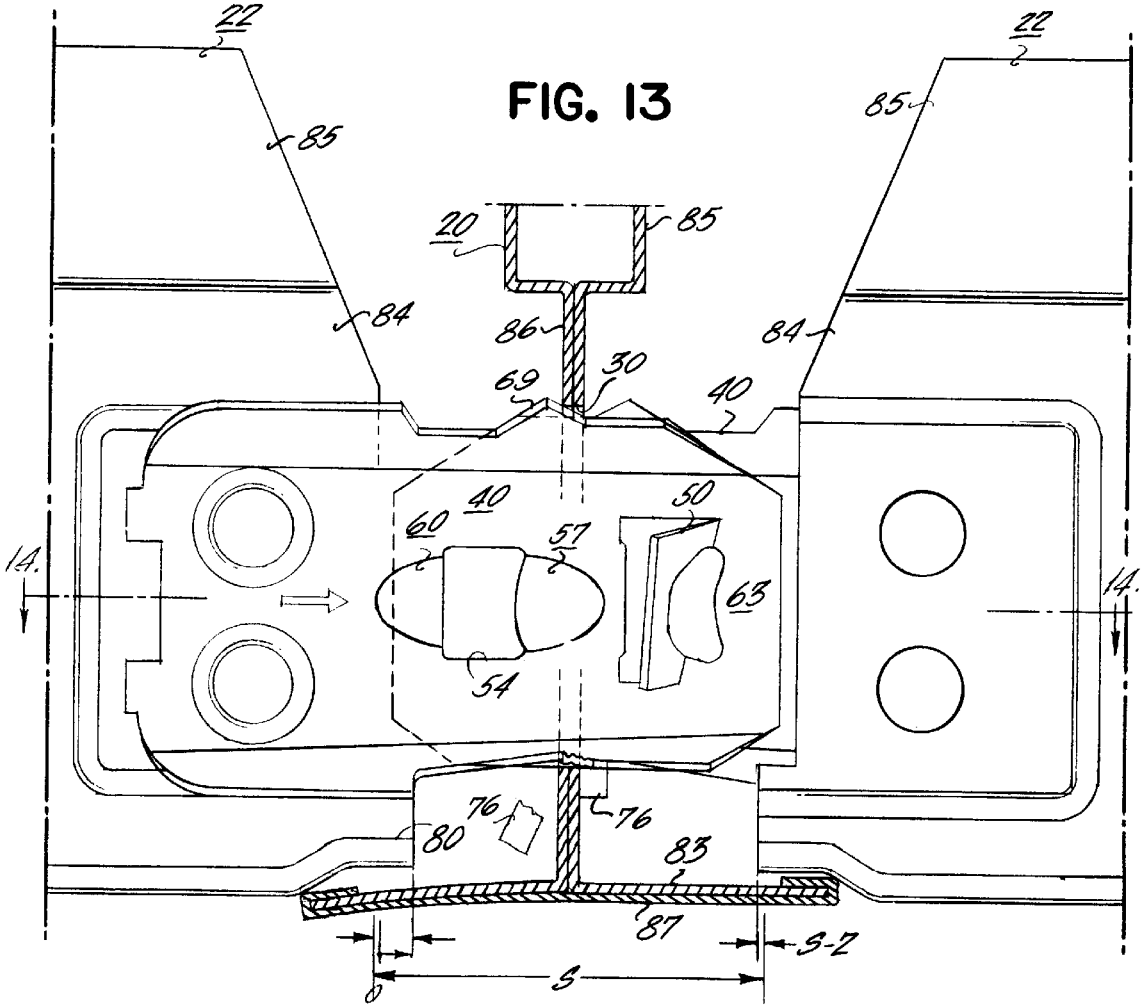
FIG. 13 is an enlarged fragmentary sectional elevational view similar to FIGS. 7 and 10 but showing one of the cross runner ends and it's associated clip having continued to expand due to a continued source of heat a distance S-3 from zero expansion, shearing away the clips lower stop tab, while the opposed clip and cross runner end remains stopped at expansion distance S-2.
Figure 14:
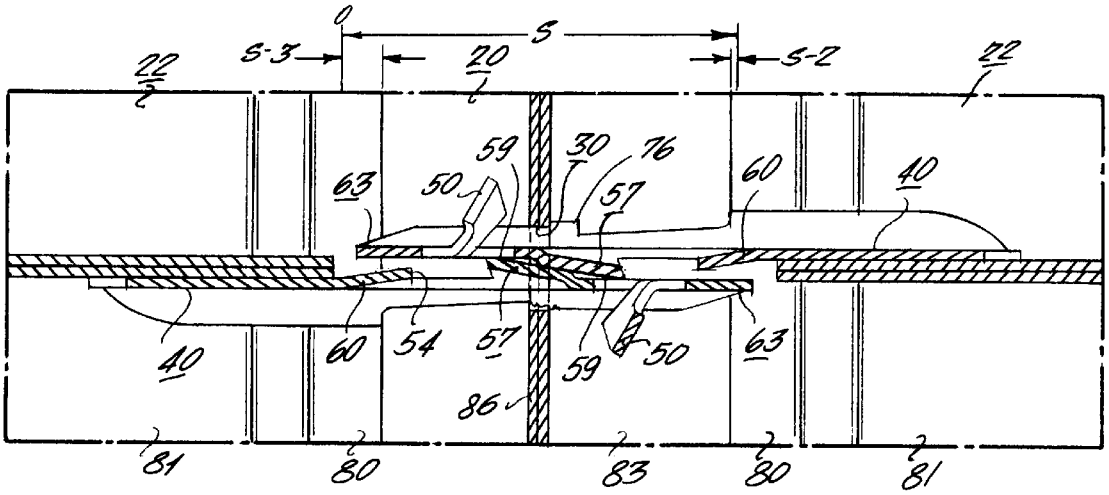
FIG. 14 is a sectional plan view taken on the line 14,14 of FIG. 13 showing the relative interengaging positions of the opposed clips as one cross runner end and associated clip expand through a distance S-3 from zero expansion while the opposed cross runner and clip remain held at expansion distance S-2.
Figure 15:
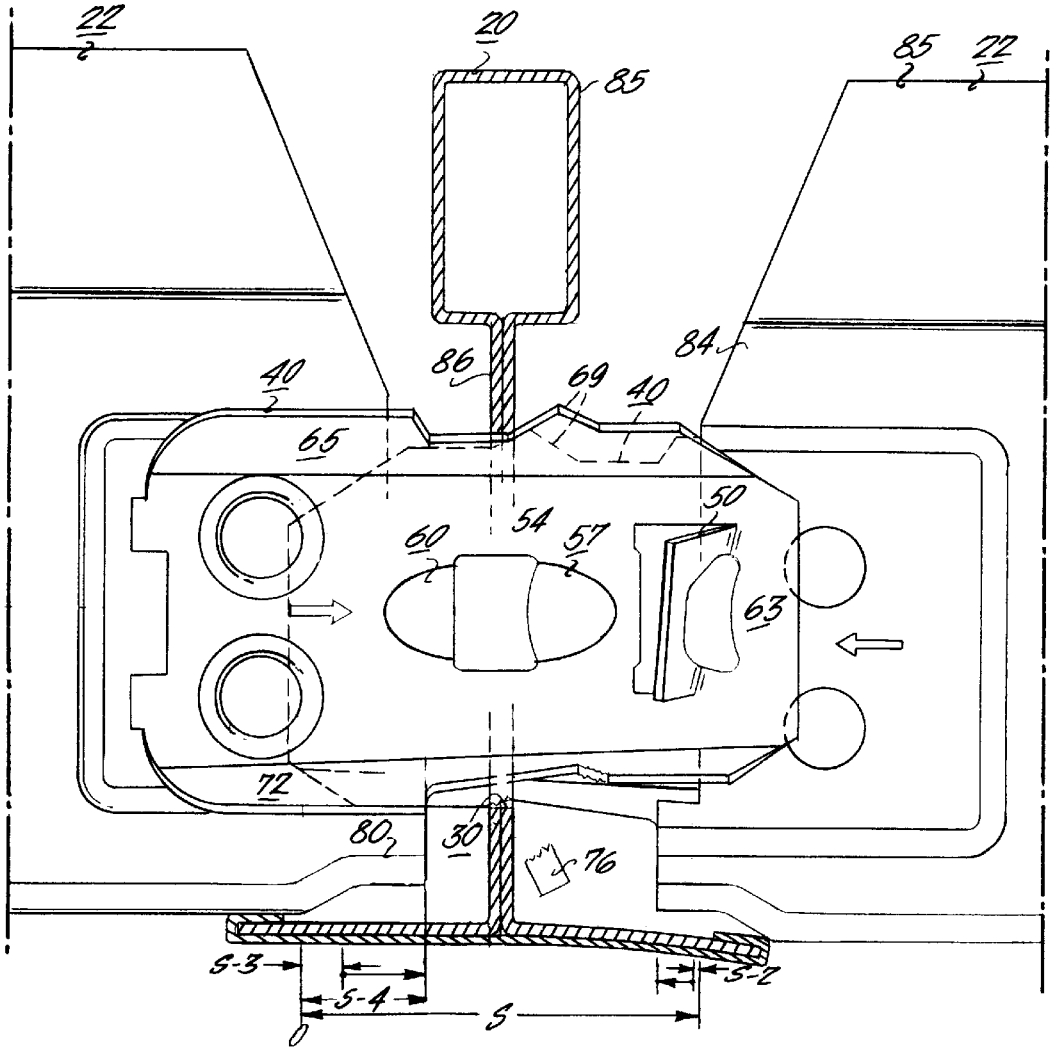
FIG. 15 is an enlarged fragmentary sectional elevational view similar to FIGS. 7, 10 and 13 but showing the first freed and expanding cross runner and associated clip having expanded through a distance S-4 at which distance the opposed runner end and associated clip expands from its held position shearing away it's lower stop tab, allowing both cross runner ends and clips to expand toward each other due to the heat from a fire.
Figure 16:
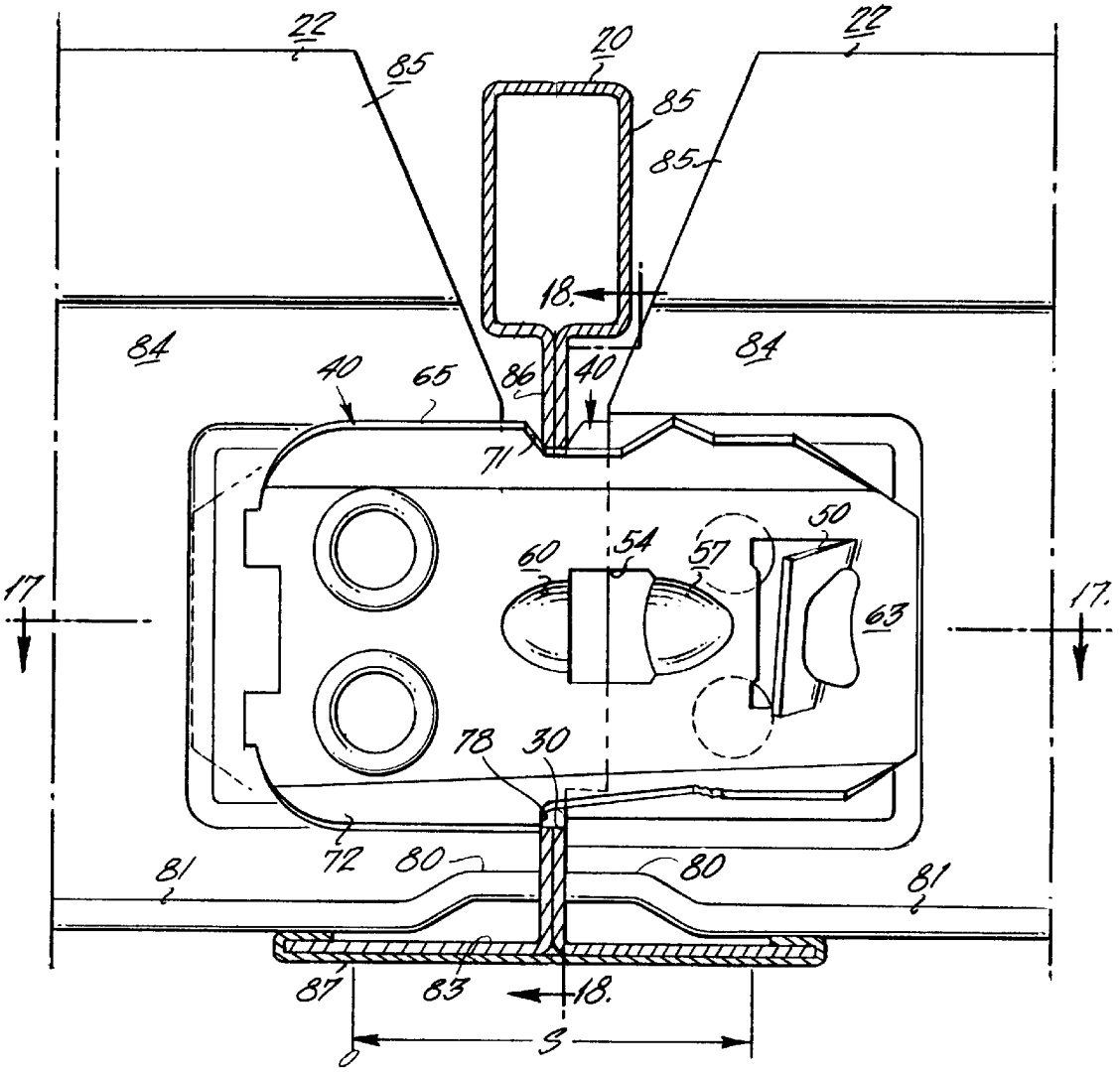
FIG. 16 is an enlarged fragmentary sectional elevational view similar to FIGS. 7, 10, 13 and 15 but showing both cross runner ends and associated clips, having expanded, due to the heat from a fire, so their overall expansion limit, where the cross runner terminal ends and the top and bottom flanged limit stops of the clips forcefully engage either side of the slotted opening in the main runner.
Figure 19:
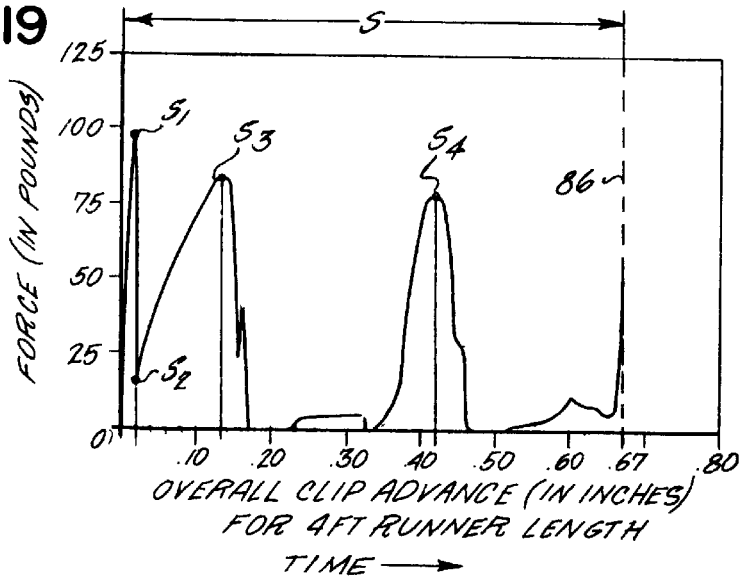
FIG. 19 is a graph showing overall expansion, in inches, plotted against force, in pounds, of resistance applied sequentially by the clips controlling the continuous expansion of cross runners.
Figure 18:
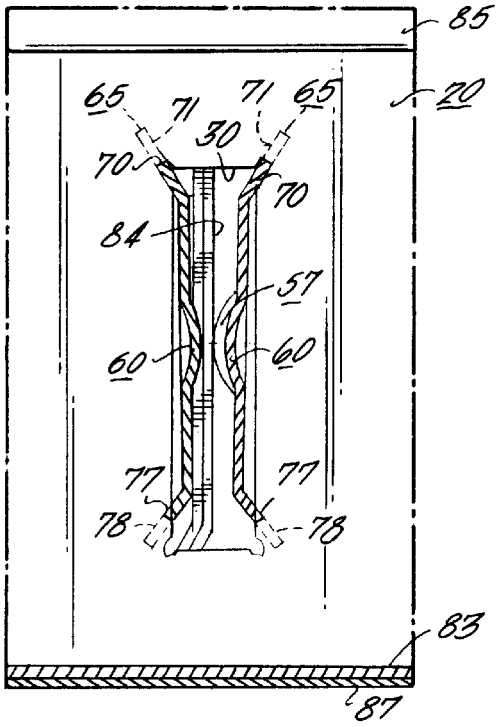
FIG. 18 is a fragmentary sectional elevational view taken on the line 18,18 of FIG. 16, similar to FIGS. 9 and 12 but showing the relative positions of the opposed clips within the confines of the slotted opening in the main runner when both opposed cross runner ends and associated clips have reached their limit of expansion.
Figure 17:
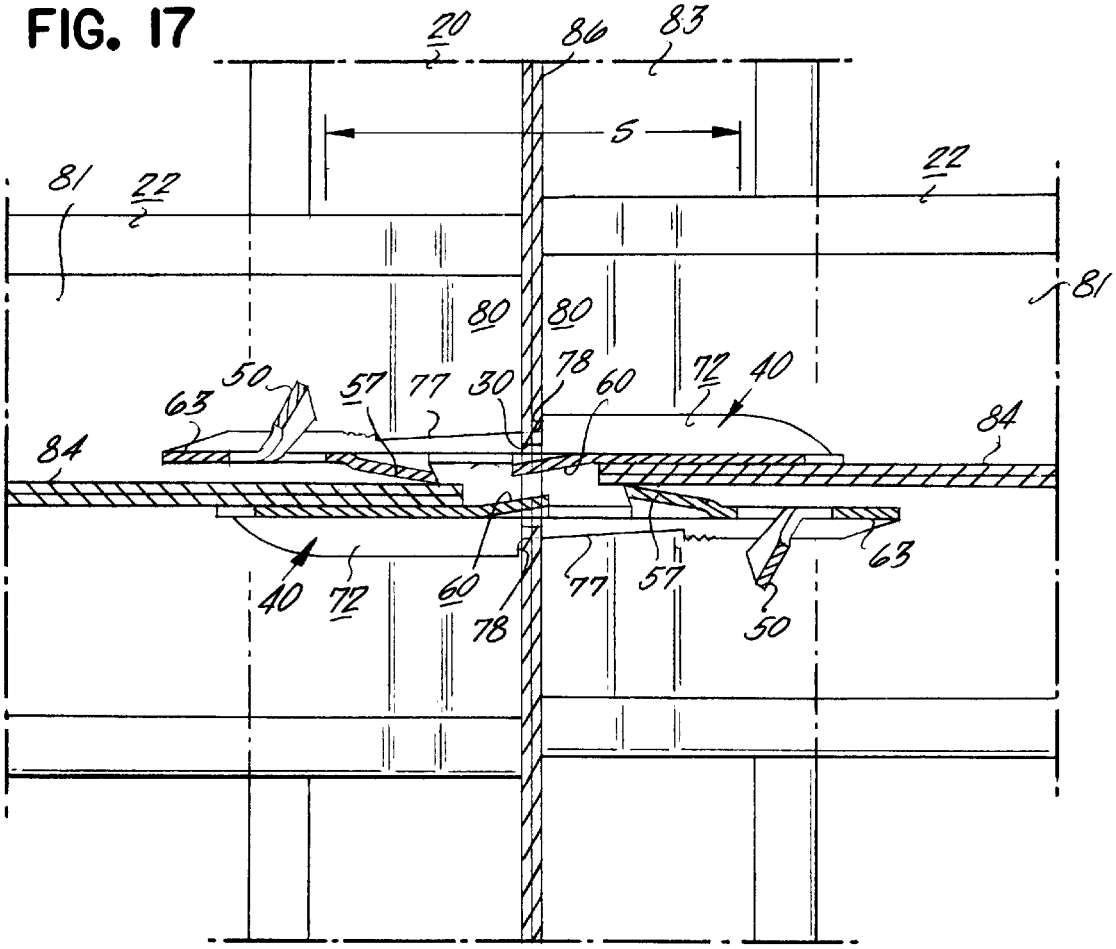
FIG. 17 is a sectional plan view taken on the line 17, 17 of FIG. 16 similar to FIGS. 8, 11, and 14 but showing the relative limit of expansion positions of both cross runner ends and their associated clips with respect to the main runner and its slotted opening.

With reference to FIGS. 7–18 and particular reference to the graph of FIG. 19, the sequential controlled expansion of two opposed cross runner ends and associated interlocked clips confined within a slotted opening in a main runner due to a fire will now be described:

a) a force of 100 or more pounds is generated by the expansion of the opposed cross runners 22 on their interlocked clips 40 due to heat from a fire.

b) the opposed interlocked clips 40 each move a distance, S-1 of approximately 0.0095 inches toward one another.

c) the interengagement of each clips cam face 59 forces the clips 40 apart unlocking vertical strips 63 from the cutouts 54 allowing each opposed clip 40 to continue to expand until the bottom stops 76 of each clip 40 abut the vertical wall 86 on either side of the slotted opening 30 of the main runner 20 a distance S-2 of approximately 0.01 inches. See FIGS. 10, 11 and 12.

d) at S-2 the expansion force diminishes to approximately 15 pounds.

e) if the heat of the fire is removed at this point the cross runners 22 and associated clips 40 can again interlock due to contraction of the runners 22.

f) with the fire continuing the heat of the fire generates a growing force on the opposed cross runners 22 and their associated clips 40 that at the distance S-2 are prevented from expanding farther due to the bottom stops 76 on the clips 40.

g) the force grows from approximately 15 pounds at S-2 to approximately 84 pounds at S-3 causing the shearing away of one of the clips stop tabs 76. See FIG. 13. At this point the freed cross runner 22 and associated clip 40 has expanded 0.066 inches from it's normal 0 position and is free to expand to it's expansion limit unopposed with the exception of smaller forces generated by the frictional contact of the clip 40 top and bottom flanges 65 and 72 adjustably working through the confines of the slot 30 in the main runner 20 and the contacting surfaces 59 of the opposed cams 57 of the opposed clips 40. See FIG. 14. The opposed cross runner 22 and clip 40 is prevented from expanding by means of it's bottom stop tab 76 as shown in FIGS. 13 and 14.

h) as the heat of the fire continues the freed cross runner 22 continues to expand through a distance S-4 approximately 0.22 inches from it's zero position as shown in FIG. 15 while the expansion force rises in the opposed cross runner and clip from 0 to approximately 78 pounds shearing away the opposed bottom clip 76 allowing the opposed runner 22 and clip 40 to expand frictionally within the slot 30 of the main runner 20.

i) as the heat of the fire continues both cross runners 22 and associated clips 40 continue to expand toward each other until the terminal ends of the cross runners 22 and the stop shoulders 71 and 78 of the clips 40 forcefully abut either side of the vertical wall 86 of the main runner 20 as shown in FIGS. 16, 17 and 18 of the drawings. As shown clearly in FIG. 18, the upper and lower corners of the slot 30 have been diagonally lanced by the upper and lower contoured edges of the flanges 66 and 73 of the clips 40 due to the outward forces generated by the inner engagement of the opposed cam surfaces 59 forcing the clips 40 apart as the two opposed clips 40 are moved to their limit positions by the expansion of the cross runners 22. In addition to these frictional forces resisting totally free expansion, an additional frictional force is generated and can best be explained with reference to FIG. 13. As the cross runner 22 expands the raised lip 80 on the terminal end of the cross runner 22 is forced over the bottom flange 83 of the main runner 20 causing the flanges 83 to deflect locally adding to this frictional engagement, the triangular portion 69 on the upper contoured flange 65 of the clip 40 cams the clip 40 downward in the slot 30 of the main runner 20 forcing the flanges 81 and 83 into even greater frictional momentary engagement. As the opposed clips 40 move toward one another within the slot 30 of the main runner 20, they undergo a series of design resistance intermittent forces both large and minimal, thus preventing an uncontrolled expansion of the cross runners. As shown in FIG. 17 of the drawings the expanding cross runners 22 and clips 40 have maintained a straight axial alignment with respect to the center line of the slot 30 in the main cross runner and are always normal to the vertical and horizontal planes of the main runner web 86.

What has been described above, by way of example, with respect to the operation of the invention, pertains to an individual connection. There are of course many such connections in a grid ceiling. The various stages of the invention occurring in an individual connection do not necessarily occur simultaneously in every connection, in that total expansion may occur at one connection, while at another connection, an expansion S-3, for instance, may be occurring.

Figure 20A:
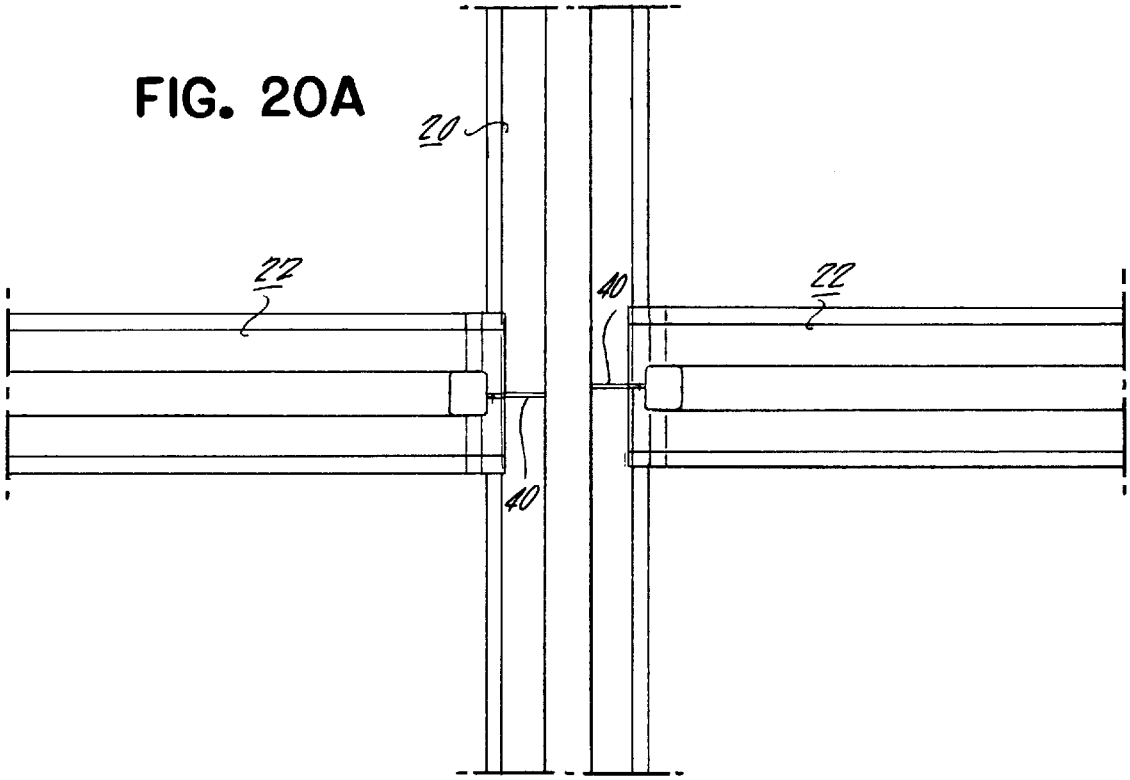
FIGS. 20A and B
Figure 20B:
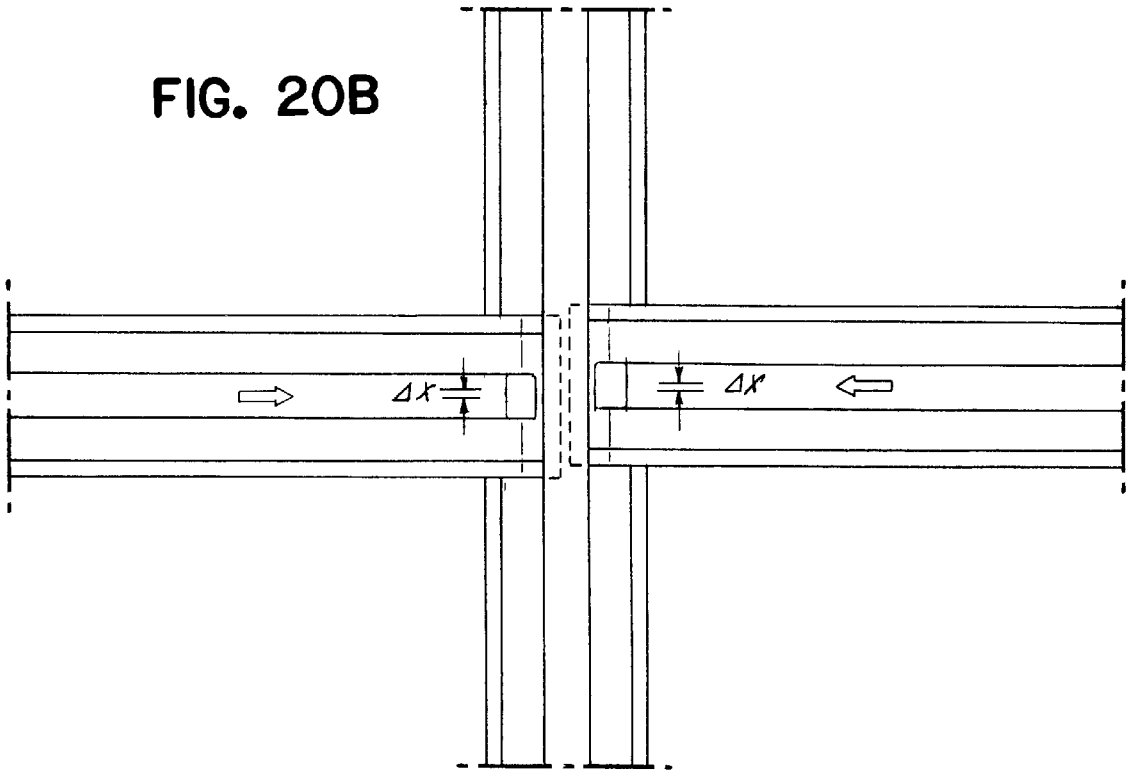

It will be thus seen by the controlled expansion of the cross runner as described above, the grid framework of the invention, which at rest is shown in FIG. 20A, maintains its orientation and position in the rectangular framework, without any negligible movement during a fire, as seen in FIG. 20B.

Figure 21A:
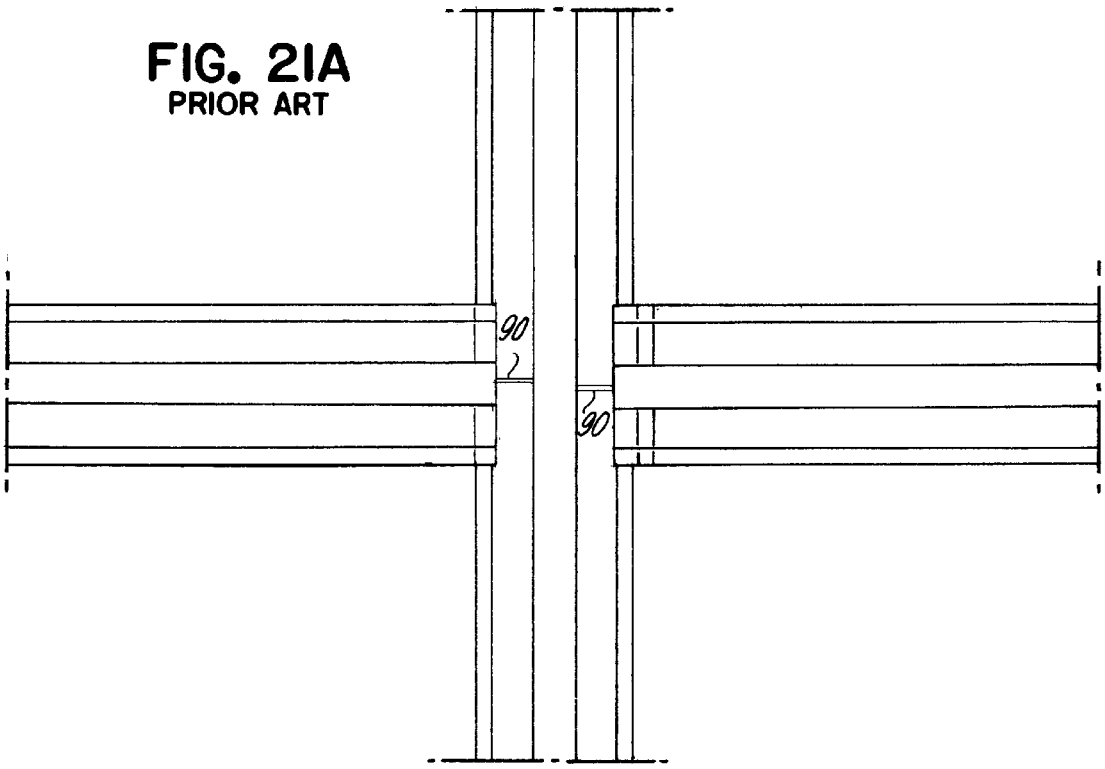
FIG. 21A PRIOR ART
FIGS. 21A and B
Figure 21B:
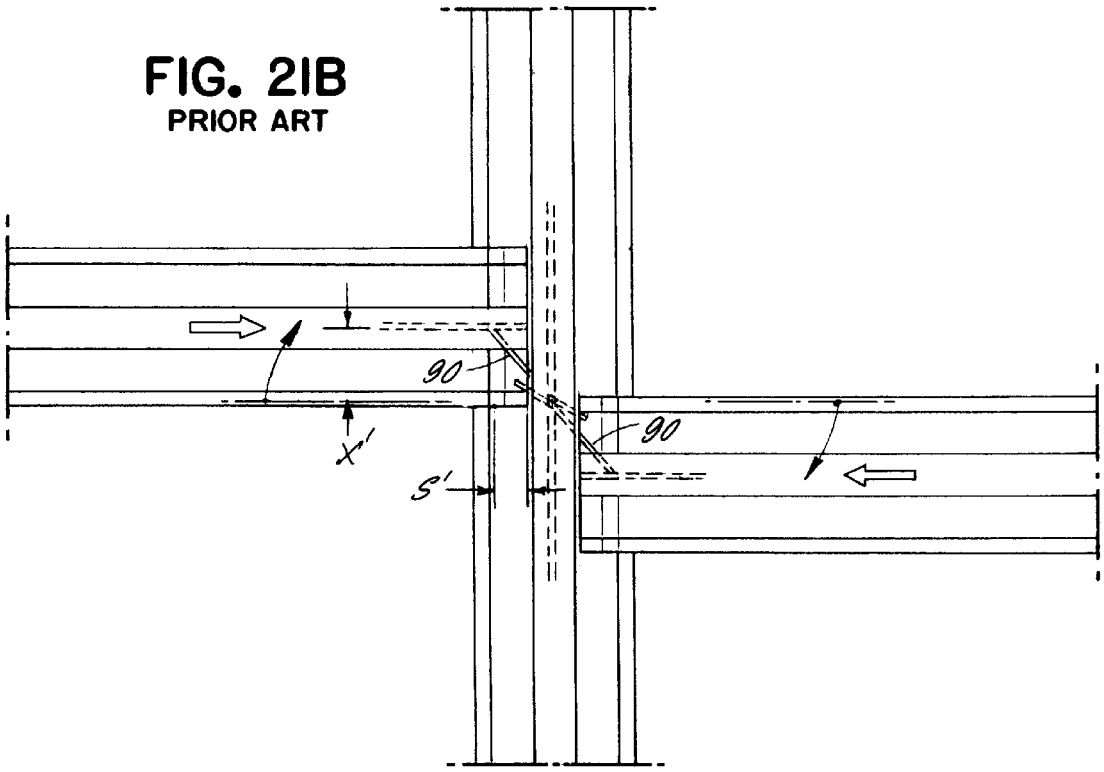
FIG. 21B PRIOR ART

In contrast, the prior art gridwork, as shown before a fire in FIG. 21A shifts, buckles, and distorts substantially during a fire, as seen in FIG. 21B. In such prior art framework, the panels would fall out of the ceiling and gaps would occur, destroying the effectiveness of the ceiling as a fire barrier. Prior art clips 90 simply bend at their weakest point as shown, throwing the cross runners out of their panel supporting position.

Although the invention has been shown with separate clips, the clips may permissibly be integrally formed of the cross runner web itself, should such be preferable.

Clip 40, by means of its angled flanges 65 and 72, is also reinforced, particularly against bending, and serves to, contributes to the increased resistance against buckling exerted by the reinforcements on the cross runner. As seen particularly in FIG. 20B, there is no bending of clip 40, whereas the prior art clip, as seen in FIG. 21B, fully bends, permitting the cross runner to move to a position in which it no longer offers substantial support to a panel in the original pre-fire rectangular formation of the gridwork.

We claim:

1. In a suspended ceiling, a system for keeping a metal framework that supports panels substantially intact in a rectangular formation during a fire comprising:

1) a main runner having a vertical slot therein;

2) a pair of cross runners having an end clip on each cross runner inserted from opposing direction toward one another through the slot wherein a) each clip has a spring engagement with the main runner that prevents withdrawal of the clip from the slot;

b) a pair of clips form an interlock, each with the other, that prevents each of the clips from further movement toward the other or away from the other;

c) each clip has a bottom stop at the bottom of the clip which abuts the main runner and prevents further entry of the clip into the slot;

d) each clip has a top stop at the top of the clip that abuts the main runner and prevents further entry of the clip into the slot;

3) the interlock, and the top and bottom stops in abutting relationship with the main runner, form means on the end clips for permitting controlled longitudinal expansion that occurs in stages to relieve longitudinal compressive forces in the cross runner caused by fire whereby the cross runners remain substantially straight and in line in the rectangular grid formations during an expansion of the cross runners caused by such fire and wherein in said means for permitting controlled longitudinal expansion a) the bottom stop is sheared off the clip by forces of expansion, b) the top stop is forced through the slot by the forces of expansion, and c) the interlock is disengaged by the forces of expansion.

2. The system of claim 1 wherein the controlled longitudinal expansion, in its final stage, permits the cross runners to expand to their maximum length from the heat of the fire.

3. The system of claim wherein the expansion occurs in stages at distances and under forces as shown in FIG. 21 of the drawings.

4. The system of claim 1 wherein the interlock formed by the clip has a backstop on each clip capable of being engaged and disengaged.

5. The system of claim 4 wherein the interlock has a cam wherein increased longitudinal compressive forces act on the cam to disengage the backstop.

6. The system of claim 1 wherein the maximum resisting force exerted by the clips to the expansion of the cross members is approximately 100 pounds.

7. The grid framework of claim 11, wherein the reinforcements are by cross stitching the web.

8. The grid framework of claim 11, wherein the reinforcements are by welding the web.

9. The grid framework of claim 11, where the clips have reinforcement against bending.

10. The grid framework of claim 9, wherein the clip reinforcements are angled flanges.

11. The system of claim 1 wherein the cross runners 1) a) are formed from a strip of flat metal into an inverted T having a web formed of layers, a bulb, and flanges, and b) have reinforcements that contribute to resisting longitudinal compressive forces created in the cross member during a fire and thus increase the compressive forces capable of being built up in the cross member without the cross member buckling, c) the reinforcements comprising means in the web of the T that keep the layers from shifting with respect to one another to avoid buckling in longitudinal compression; and 2) the reinforcements enable an individual cross runner to increase its resistance to buckling from longitudinal compression forces in the cross runner caused by the fire while the means on the end clips for permitting controlled expansion relieve, in stages, such increases in longitudinal compressing forces to avoid such buckling.

* * * * *